US005248049A

United States Patent [19]

Murphy, Sr.

[11] Patent Number: 5,248,049

[45] Date of Patent: Sep. 28, 1993

[54] NUT AND BOLT ROTATING TRAY CADDY

[76] Inventor: James E. Murphy, Sr., 1670 Glendale Avenue, Windsor, Ontario, Canada, N8T 2N2

[21] Appl. No.: 901,821

[22] Filed: Jun. 22, 1992

[51] Int. Cl.[5] ..... A47F 5/00

[52] U.S. Cl. ..... 211/164; 211/78; 211/131

[58] Field of Search ..... 211/164, 78, 95, 131

[56] References Cited

U.S. PATENT DOCUMENTS

| | | | |
|---|---|---|---|
| 253,290 | 2/1882 | Hunter | 211/164 X |
| 570,322 | 10/1896 | Mansfeld | 211/164 X |
| 643,959 | 2/1900 | Greenspan | 211/164 |
| 919,725 | 4/1909 | Huffman | 211/164 X |
| 1,281,105 | 10/1918 | Unger | 211/164 |
| 3,038,773 | 6/1962 | Vasbinder | 211/164 X |
| 3,784,024 | 1/1974 | Kristy | 211/164 X |

*Primary Examiner*—Robert W. Gibson, Jr.
*Attorney, Agent, or Firm*—Mitches & Co.

[57] ABSTRACT

A rotating or carousel-like tray caddy for holding nuts, bolts and the like and consists of a horizontally oriented carousel carrying a carousel holding means into which are fitted removable trays or drawers. The carousel itself has an overall handle on the carousel frame so as to allow the carousel to be moved from place to place, and horizontal rotation of the carousel itself when placed on a surface and the removal of the tray or trays from the carousel, if required.

5 Claims, 2 Drawing Sheets

NUT AND BOLT ROTATING TRAY CADDY

This invention relates to a nut and bolt rotating carousel tray caddy.

BACKGROUND OF THE INVENTION

Particularly, the invention relates to a removable tray which allows, on the one hand, each tray to be removed from the caddy and secondly, the rotating carousel to be removed from the holding frame.

In the management of nut bolts and the like, it is difficult to have a portable device which can be carried from site to site while at the same time, organizing the nuts, bolts, washers and the like; locating them in a convenient and logical manner.

THE INVENTION

The invention therefore achieves a portable device, including a carrying frame, a carousel sub-frame defining means for holding bolt accomodating trays in a fashion which allows the trays to be removable therefrom and to be rotated into and out of a usable position.

BRIEF DESCRIPTION OF THE DRAWINGS

The invention therefore contemplates a rotating tray caddy comprising a carrying frame having two spatially disposed upright pillars and a handle piece interconnecting the pillars as means to hold and stabilize and to carry the same, each pillar defining a carousel carrying region and a carousel having spatially disposed radial members, each radial member having indexing means for indexing into said carrying region on one of said pillars, and also carrying a pivot tray support structure between each radial member whereby, on rotation of the carousel in the carrying frame, the tray support member is maintained in a horizontal plane. Particularly, the radials are radial arms which have pivot points carrying a pivoting tray support between opposite radial arms. Removable tray, having handles are indexed into and removable from the pivoting tray supports.

The invention will now be described by way of example and reference to the accompanying drawings in which.

THE PREFERRED EMBODIMENT

Figure 1:
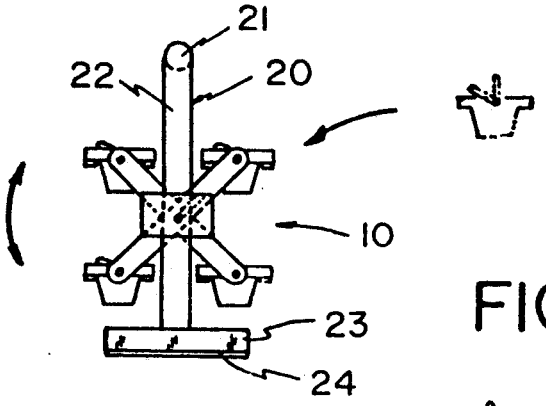
FIG. 1 is a perspective view of the invention.

The rotating tray caddy is generally indicated as 10 and is shown in its end view assembled environment in FIG. 1.

It consists generally of a rigid frame 20 including a horizontally oriented cylindrical handle member 21 terminating at vertical end members 22, which terminate in a bottom rectangular base portion 23, which acts as a circumscribing rail or perimeter to a bottom sheet 24, which acts as a collection depot for discarded nuts, screws, waste and the like.

Each of the vertical end members 22 has a block piece 23 mounted approximately half-way along its length which acts as the pivot axis for a carousel, generally indicated as 30, which is adapted to engage and to be mounted therein and to rotate thereon, since each block 23 has an aperture 24 that is respectively co-linear and into these apertures, extend an axle 35 of the carousel. In fact, the axles 35 are but a slidable cylindrical piece, such as a nail, that allows the carousel to be inserted into and removed from the frame 20. The carousel 30 features end cross members 31, the distal ends of which carry apertures 32 into which a pivoting axis 33 extends from a tray-support cross member 34 whose ends respectively are rigidly attached to a longitudinal tray-support member 36.

The carousel rotates and the tray-support members 34 and 36 rotate therewith.

Figure 3:
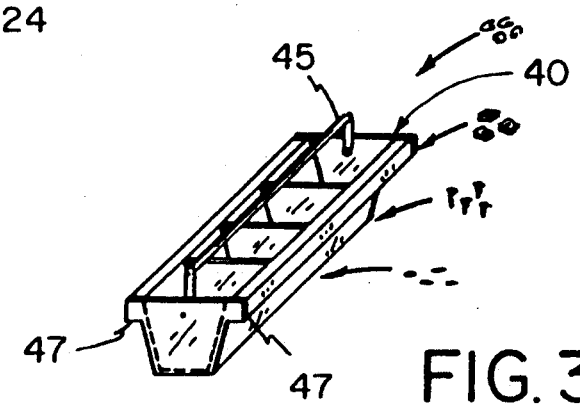
FIG. 3 is a perspective assembly view of one of the trays according to the invention.
Figure 4:
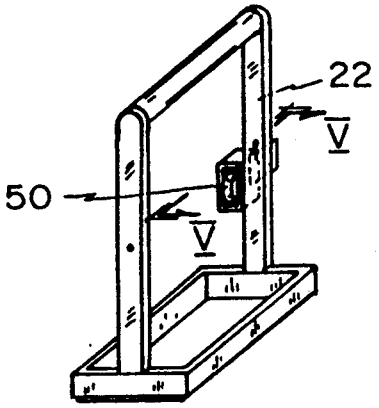
FIG. 4 is a perspective view and alternative embodiment illustrating breaking section.
Figure 5:
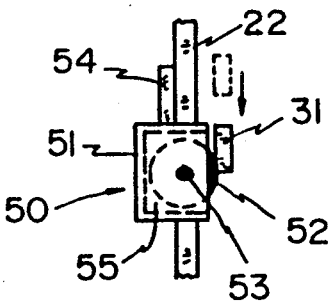
FIG. 5 is a partial section along V—V of FIG. 4.

A plurality of tool trays, each generally indicated as 40, and may be compartmentalized as shown, and have a horizontal pivoting lifting handle 45 which allows the tray to be removed from the tray support members 34 and 36 in the lifting position. This is shown in phantom in FIG. 1 and in the solid in FIG. 3. The phantom position of FIG. 1 for the handle 45 shows its rest position which is used during carousel rotation or when removal from or insertion into the tray 40 of nuts, bolts and the like takes place.

Each tray is in cross-section, generally U-shaped with lateral flange pieces 47, the under surface of which bears on top of the lateral support member 36 to hold the tray on the carousel.

Figure 2:
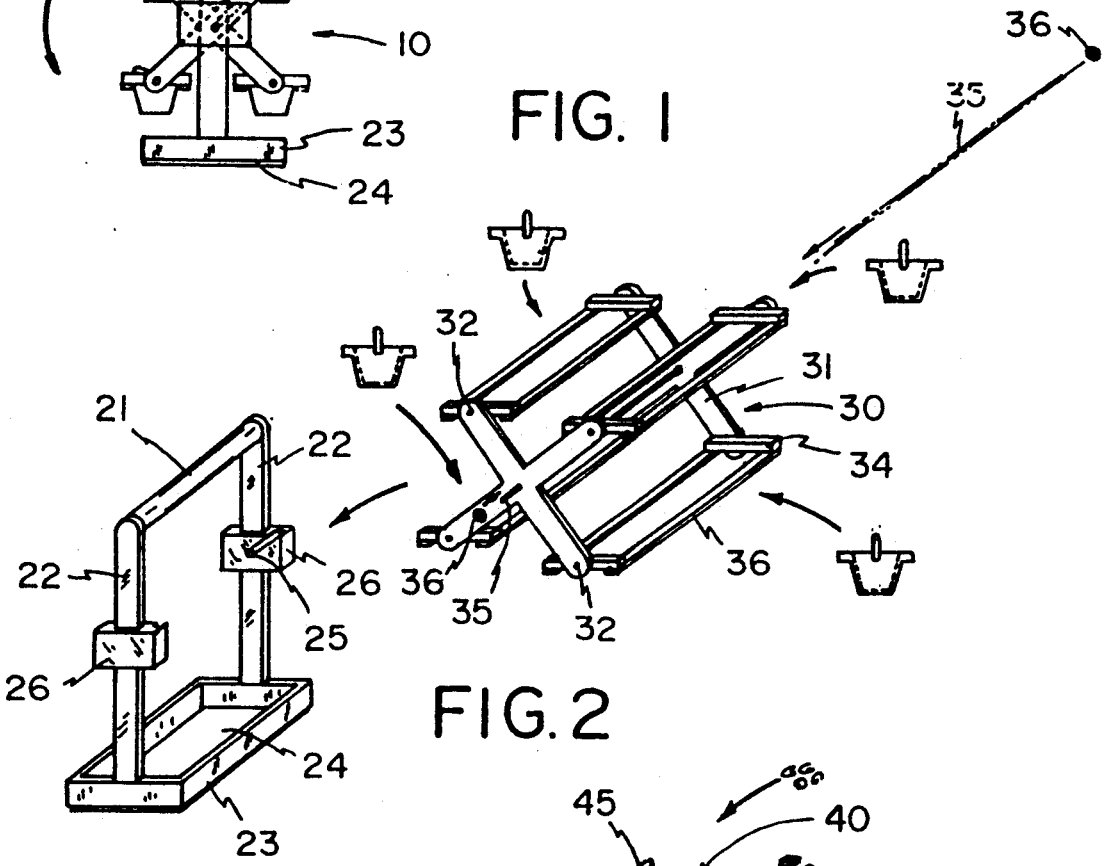
FIG. 2 is a perspective assembly view of the invention.

In order to provide removal, each of the blocks may be provided with a diagonal slit 25, as seen in FIG. 2 so that the axis 35 may fit therein. Alternatively, the axis 35 may be removable, as shown in the assembly figure, FIG. 2 with onel end thereof having a friction-fitting O ring 36 for frictional engagement with one end of the removable axis 35. In that instance, only one of the blocks 26 need to have the diagonal accomodating axis slit 25.

In order to accomodate breaking and locking in position of another rotating tray caddy, as shown in the end FIG. 1, a break block means, generally shown as 50 may be mounted at one end and include a cover or housing 51, a rubber disk or the like 52 held to the vertical pillar 22 by a fastening arrangement such as screww 53. The cordial position of the disk 52 is such as to interfere with the passing of any of the cross-arm 31 and thereby hold them in a fixed position and thereby stable the tray placement in a manner shown in FIG. 1. Alternative means of holding the trays 40 in position will be apparent to those skilled in the art.

I claim:

1. A rotating tray caddy comprising:

(a) a carrying frame having two spatially disposed upright pillars and a handle piece interconnecting the pillars as means to hold and stabilize and to carry the same, each pillar defining a carousel carrying region; and, (b) a carousel having spatially disposed radial members, with distal ends each radial member having indexing means for indexing into said carrying region on one of said pillars, and also carrying, near their respective distal ends, pivoting means adapted to carry a pivoting tray support structure between respective opposite pivoting means or each radial member whereby, on rotation of the carousel in the carrying frame, the pivoting tray support members are maintained in a horizontal plane.

2. The tray caddy as claimed in claim 1, wherein the indexing means is a removable indexing means.

3. The tray caddy as claimed in claim 1, wherein the radial members are radial arms carrying at their distal end pivot points, each pivot point carrying a pivoting tray support extending between opposite radial arms.

4. The tray caddy as claimed in claim 3 including a removable tray means adapted to index into and be carried by the tray support structure.

5. The tray caddy as claimed in claim 4 wherein each removable tray means includes a handle member by which it may be removed and carried away from the carousel.

* * * * *